US006398643B1

(12) United States Patent
Knowles et al.

(10) Patent No.: US 6,398,643 B1
(45) Date of Patent: Jun. 4, 2002

(54) PROMOTIONAL GAMING DEVICE

(76) Inventors: Allan G. S. Knowles, 52 Onslow Road, Walton-On-Thames, Surrey KT12 5AZ (GB); Conor O'Neill, 67 High Street, Hampton TW12 25X (GB); Wouter Goede, Rembrandtlaan 20, NL 2102 BR Heemstede (NL)

( * ) Notice: Subject to any disclaimer, the term of this patent is extended or adjusted under 35 U.S.C. 154(b) by 0 days.

(21) Appl. No.: 09/409,155

(22) Filed: Sep. 30, 1999

(51) Int. Cl.[7] ..... A63F 3/06; A63F 9/12; B42F 21/00

(52) U.S. Cl. ..... 463/17; 463/40; 273/157 A; 283/36

(58) Field of Search ..... 463/17, 18, 19, 463/40, 41; 273/157 A, 269, 271; 283/36, 94, 99

(56) References Cited

U.S. PATENT DOCUMENTS

| | | | | |
|---|---|---|---|---|
| 3,517,947 A | | 6/1970 | Bennet | |
| 3,873,092 A | * | 3/1975 | Fagan | 273/135 B |
| 3,958,816 A | | 5/1976 | Remmey, III | |
| 4,159,129 A | | 6/1979 | Lockhart | |
| 4,349,346 A | * | 9/1982 | Broberg | 493/325 |
| 4,379,573 A | | 4/1983 | Lomeli et al. | |
| 4,586,711 A | * | 5/1986 | Winters et al. | 273/138 R |
| 4,607,845 A | * | 8/1986 | Gallo | 273/148 R |
| 4,688,797 A | * | 8/1987 | Sebestyen | 273/148 R |
| 4,711,454 A | * | 12/1987 | Small | 273/269 |
| 4,781,378 A | * | 11/1988 | Clinnin et al. | 273/138 R |
| 4,846,504 A | | 7/1989 | MacGregor et al. | |
| 4,978,143 A | | 12/1990 | Ericson | |
| 5,332,265 A | | 7/1994 | Groess et al. | |
| 5,352,155 A | | 10/1994 | Fahey | |
| 5,413,384 A | | 5/1995 | Principe et al. | |
| 5,641,182 A | | 6/1997 | Schwandt | |

FOREIGN PATENT DOCUMENTS

| | | | |
|---|---|---|---|
| BE | 882701 | * | 7/1980 |

* cited by examiner

*Primary Examiner*—Mark Sager
*Assistant Examiner*—Steven Ashburn
(74) *Attorney, Agent, or Firm*—Handal & Morofsky

(57) ABSTRACT

A promotional gaming device for determining whether a player has matched a predetermined winning sequence of characters or symbols. The gaming device is comprised of a substrate having at least one row of location designating symbols and at least one column of location designating symbols disposed in relation to each other so that a position may be designated by a combination of at least one of the symbols from the row and at least one of the symbols from the column. Groups of sequence representing elements are disposed on the substrate which represent elements having a corresponding position designated by the positional combination of at least one of the symbols from the row and at least one of the symbols from the column. A promotional product label having a plurality of marks disposed thereon is addressable by one of the sequence representing elements when the substrate is placed over the promotional product label, and each of the marks identifies a sequence representing element that in combination forms a gaming sequence which can be compared to the predetermined winning sequence.

35 Claims, 11 Drawing Sheets

| | A B C D | E F G H | I J K L | M N O P | Q R S T | U V W X | Y Z |
|---|---|---|---|---|---|---|---|
| 0 | | | | | | | |
| 1 | 1 6 1 7 | 2 8 1 9 | 1 0 5 9 | 5 7 4 8 | 5 6 5 0 | 3 8 3 7 | 1 6 |
| 2 | 2 7 2 8 | 1 9 2 0 | 2 6 4 0 | 4 8 3 9 | 4 7 4 6 | 5 9 5 8 | 2 7 |
| 3 | 3 8 3 9 | 4 0 3 6 | 3 7 2 6 | 2 9 5 0 | 2 8 2 7 | 1 0 1 9 | 3 8 |
| 4 | 4 9 4 0 | 5 6 4 7 | 4 8 3 7 | 3 0 1 6 | 3 9 3 8 | 2 6 2 0 | 4 9 |
| 5 | 5 0 5 6 | 3 7 5 8 | 5 9 1 8 | 1 6 2 7 | 1 0 1 9 | 4 7 4 6 | 5 0 |
| 1 | 1 6 1 7 | 2 8 1 9 | 1 0 5 9 | 5 7 4 8 | 5 6 5 0 | 3 8 3 7 | 1 6 |
| 2 | 2 7 2 8 | 1 9 2 0 | 2 6 4 0 | 4 8 3 9 | 4 7 4 6 | 5 9 5 8 | 2 7 |
| 3 | 3 8 3 9 | 4 0 3 6 | 3 7 2 6 | 2 9 5 0 | 2 8 2 7 | 1 0 1 9 | 3 8 |

pinwin

Wash Whiter pinwin ™ game

Remember to have your pinwin sleeve and card ready

Mr Bloggs, Wash Whiter pinwin card number

WWPW147895379D

Today's winning reference for you: B4

Does the pinwin card show 1234

Yes or No?

Figure 13A

PROMOTIONAL GAMING DEVICE

BACKGROUND OF THE INVENTION

1. Field of the Invention

The present invention relates to a reusable gaming device, more particularly to a promotional gaming device which can be used in conjunction with various promotional media.

2. Description of Related Art

Including Information Disclosed Under 37 CFR 1.97 and 37 CFR 1.98

Gaming is an entertainment activity with an increasingly widespread availability involving numerous applications. Presently, gaming is a diverse industry implementing a large variety of systems that enable players to participate in various forms of traditional games of chance such as instant ticket-type games, traditional lottery drawing games, and match games as well as more sophisticated electronic and video games.

One system of gaming is that of the instant ticket game. In the case of typical paper instant tickets, a computer generates a randomized prize data stream comprised of a finite series of win/lose outcomes. Each outcome is assigned to a lottery ticket, and each ticket contains one or more game chances which yield the assigned outcome. The player cannot change the ticket outcome; he or she merely scratches off an opaque covering on the ticket in accordance with the rules of the game to reveal win/lose results or prize status.

Remote gaming systems, and more particularly, off-line systems for playing games of chance including instant-type lottery games typically embody playing tickets on a game computer. These systems offer the same convenience as typical paper scratch-off tickets without the gaming computer ever having to be physically or electronically connected to a lottery system network during play.

In both types of instant win games, the primary benefit to the maker of the game is an incoming revenue stream. The advantage to players of instant-win tickets is the ability to obtain immediate gratification. Unlike holders of tickets for scheduled prize drawings, for example, who must await completion of the drawings to determine whether they have won any prize, purchasers of instant-win tickets are able to discern the extent of their successful play immediately after acquiring the tickets. However, empirical evidence suggests that some purchasers prefer greater involvement with the games presented on the tickets than many instant-win tickets typically provide. As a consequence, more recently created games have been extended to provide additional play tickets. These types of games are either multiple in number or are not limited to removing a single opaque covering.

Match games of chance such as Bingo and Keno are also becoming more popular world wide, particularly in the United States. Bingo parlors are proliferating, both as charity fund raisers and as legal for-profit ventures. Also, currently at least 30 state and provincial lotteries have adopted a bingo card format for their instant prize winner lottery cards. These cards are typically "Scratcher Bingo" games in which a caller's card and as many as four separate bingo squares are displayed. The player scratches off the play spaces which match numbers on the caller's card, attempting a traditional bingo match of vertical, horizontal or diagonal lines or four corners. The game cards can take a full 10 to 15 minutes to complete and are popular due to the hands-on participation required. Typically a player has a chance to win multiple prizes from a single card via the multiple bingo squares. Keno, although less well known, is proliferating as well with the expansion of legal gambling facilities.

Until recently, game creators were unaware of any effort (other than their own) to link games of chance with the personal computers of those who purchase the instant-type lottery tickets or play match games such as Bingo or Keno. However, a 1996 brochure of Gizmo Enterprises, Inc. entitled "Interactive Multimedia Lottery Ticket" touts a product called "WinWare." According to the brochure, "WinWare" is "an improved lottery ticket that increases the excitement of lottery play." Players purchase tickets from existing retailers, then use their home computer or a retail gaming system to play interactive lottery games. There is no skill involved because the outcome of the game is controlled by the ticket. When players win they simply bring their tickets back to the retailer and collect the prize.

It is apparent that with the recent widespread popularity of personal computers, the availability of on-line services, the increasing popularity of instant-type lottery and match games such as Bingo and Keno, and the increasing popularity of gaming in general, a faster and more convenient method of gaming entertainment could be developed using the Internet. Once proclaimed to be the "information superhighway," the Internet has now become the "advertisement superhighway," and, as such, is able to provide gaming opportunities directly to a person in the privacy of his own home through cyberspace while at the same time exposing the person to a manufacturer's line of product.

In addition to Internet gaming, regardless of whether it is provided to the consumer strictly for his own entertainment or to induce him to purchase consumer products, a more desirable and convenient method of promoting the sale of consumer products could be developed. Such a promotion method could limit, or even eliminate, the requirement for paper manufacturer's coupons and could allow manufacturers an opportunity to promote specific products without altering product containers or attaching special coupons to the products or store shelves. The method could also allow consumers to personally select product categories and products within the selected categories for refund or discount information in advance of their shopping trip, and, to be effective, the method could generate consumer interest and excitement by the use of a game format for the selected product categories. Finally, the method would save valuable natural resources by specifically targeting rebate and coupon offers only to those consumers who actively solicit such offers.

Because of the increased interest in instant-ticket type games, traditional lottery-drawing games, and match games such as Bingo and Keno, there is a need to provide people with an easily accessible forum to afford them the opportunity to participate in recreational gaming. Furthermore, because there is an ever-increasing need to conserve valuable natural resources, the linking of recreational gaming with the potential to reduce environmental waste may serve that end.

SUMMARY OF THE INVENTION

The invention contemplates a reusable promotional gaming device for determining whether a player has matched a predetermined winning sequence of characters or symbols. The invention consists of a substrate having at least two rows of location designating symbols so that a position may be designated by a combination of at least one of the symbols from each row. The invention also contemplates groups of sequence representing elements disposed on the substrate. These sequence representing elements have a corresponding position designated by the positional combination of at least one of the symbols from each row of location designating symbols. The invention furthermore contemplates a promotional product label having marks disposed on the label. Each of the marks are addressable by one of the sequence representing elements when the substrate is placed over the promotional product label. Each mark furthermore identifies a sequence representing element that in combination forms a gaming sequence which can be compared to the predetermined winning sequence.

The substrate of the gaming device may be either transparent or translucent. The location designating symbols are arranged in a row and in a column, and the sequence representing elements may be comprised of either integers or letters. These sequence representing elements may be predisposed on the substrate in either varying patterns or in a random fashion.

The invention also contemplates a method of playing a game using a gaming device. The first step in playing the game is the placing of a gaming card over marks disposed on a promotional product label. The gaming card is a substrate having at least two rows and at least two columns of designating symbols disposed in relation to each other so that a position may be designated by a positional combination of at least one symbol from each row and each column. The substrate has disposed onto it groups of sequence representing elements having corresponding positions designated by a positional combination of at least one of the designating symbols from each row and column. Each of the marks disposed on the promotional product label is addressable by one of the sequence representing elements disposed on the substrate when the gaming card is placed over the promotional product label.

Subsequent steps in playing the game involve locating each address where the marks on the promotional product label are visible below each of the sequence representing elements, identifying a corresponding sequence element which forms a portion of a gaming sequence, and comparing the gaming sequence representing elements to a predetermined winning sequence.

In the method of playing the game the substrate may be either transparent or translucent, and the location designating symbols are arranged in a row and in a column. The sequence representing elements may be comprised of integers or letters, and they may be disposed onto the substrate in either varying patterns or in a random manner.

The invention further contemplates a promotional gaming device for determining whether a player has matched a predetermined winning sequence. This device contains a first graphical element having at least one row and at least one column of location designating symbols. These location designating symbols are disposed in relation to each other so that a position may be designated by a positional combination of at least one symbol from one row and at least one symbol from one column.

The device also contains groups of sequence representing elements that are displayed on the first graphical element. These sequence representing elements have a corresponding position designated by the positional combination of at least one symbol from each row and at least one symbol from each column.

The device further contains a second graphical element having marks disposed on it. Each of the marks are addressable by one of the sequence representing elements when the first graphical element is place over the second graphical element, and each mark identifies a sequence representing element that in combination forms a gaming sequence which can be compared to the predetermined winning sequence.

The graphical elements may be displayed electronically on a computer screen. The computer screen may be connected to a remote database, and the remote database may be located on the Internet.

In this embodiment of the promotional gaming device, the user can position a computer-imaged cursor over the first graphical element and activate a dragging element enabling the user to position the first graphical element over the second graphical element. The marks can be perceived through the first graphical element and can be correlated with sequence representing elements, which are compared to a predetermined winning sequence. The graphical elements of the gaming device may have a unique identifying code associated with them enabling them to be validated by the game administrator.

Another method of playing the game using a gaming device as above can be carried out by placing a gaming card over marks preprinted onto an item, locating each address where the marks are visible below each of the sequence representing elements when the gaming card is placed over the promotional product label, collecting points based on the result of a mathematical computation derived from the integral values corresponding to the marks at each of the addresses, and redeeming the points collected from the mathematical computation for a prize.

The game can furthermore be played using a telephone by calling a telephone number designated by the game administrator and listening to pre-recorded messages or advertisements. The caller would then obtain information specifying a location at which a gaming device would be placed, place the gaming device at that place over a group of marks disposed on a promotional product label, and locate each address where the marks are visible below each of the sequence representing elements. The player then identifies a corresponding sequence element that forms a portion of a gaming sequence and compares the gaming sequence representing elements to a predetermined sequence. This gaming method may also have a unique identifying code associated with it for validation purposes, and it may be played across a telephonic paging system. Furthermore, the inventive system may be used in conjunction with an Interactive Voice Telephony system or an Interactive Voice Response/Recognition system.

Yet another embodiment of the invention contemplates a method for obtaining biographical and geographical information relating to a consumer. The first step of this method is the electronic interconnection of an electronic computer with a remote database which may be connected at an Internet site. The second step is the electronic displaying on the computer monitor of advertisements and a graphical element which can be dragged over and dropped onto a second graphical element which contains marks. The marks on this second graphical element are addressable by sequence representing elements when the first graphical element is dragged and dropped over the marks. The third step is the allowance of a player to collect a prize if the player's first graphical element recites a winning sequence. The final step involves the player's collection of his prize in exchange for the player giving biographical and geographical information relating to himself which can be used in demographic studies by the promoter of the game.

Still another aspect of the invention contemplates a method of verifying information collected by comparing a first piece of data collected to a subsequent piece of data collected. The first piece of data is then compared to the second piece of data, and, if the two pieces of data are in response to the same question and if they differ, the data is flagged and verified by the game administrator.

BRIEF DESCRIPTION OF THE DRAWINGS

One way of carrying out the invention is described in detail below with reference to drawings which illustrate only one specific embodiment of the invention and in which:

FIG. 13*a* is a front view of an embodiment of the invention wherein the reference and winning numbers are given over a computer system, but the game is played with a physical gaming device;

DETAILED DESCRIPTION OF THE PREFERRED EMBODIMENTS

Figure 1:
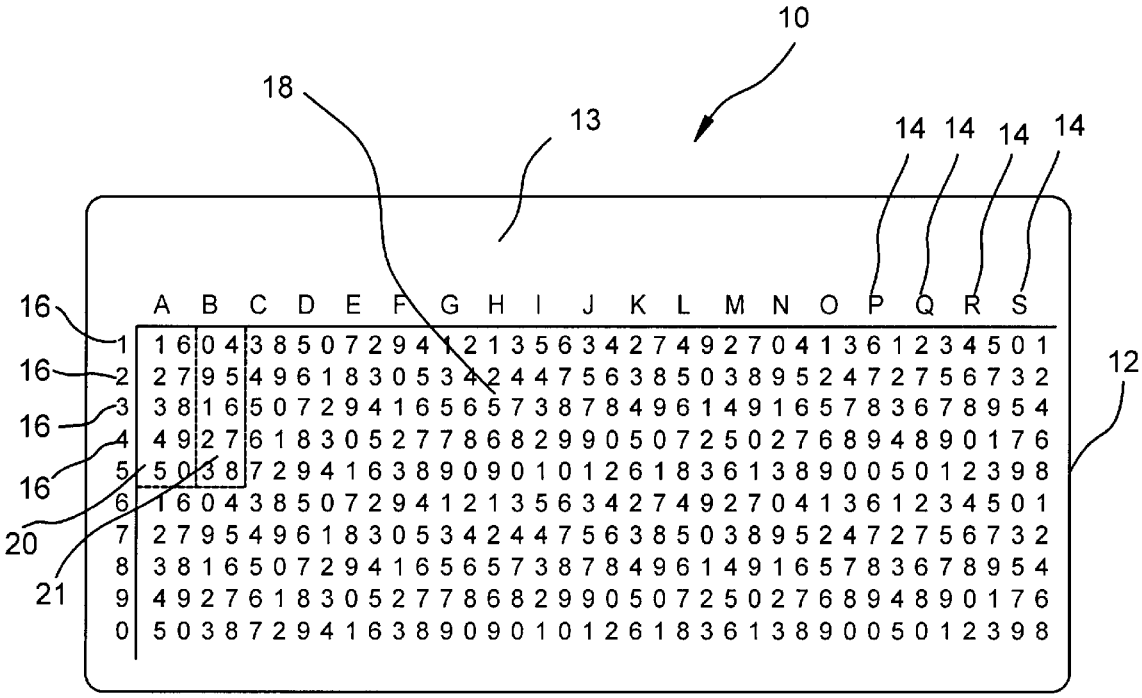
FIG. 1 is a plane view of one embodiment of the substrate of the gaming device.

Referring to FIG. 1, an embodiment of the gaming device 10 comprises a substrate 12, which may be made from plastic, paper, or a similar material. Further, the substrate 12 may be transparent, colored, or frosted and have a header portion 13 which is opaque to facilitate printing on the front and backsides of the header portion 13, for example, for printing the name and/or logo of a business. Location designating means are disposed on the substrate 12 by printing, etching or the like. In the embodiment shown in FIG. 1, the location designating means comprises first location designating symbols, such as letters 14 disposed on the substrate in a row and second location designating symbols, such as numerals 16 disposed on the substrate 12 in a column. A location 18 (for example H3) is thus designated by the letter H of the first location designating symbols 14 and the numeral 3 of the second location designating symbols.

Sequence representing means, such as sequence representing numerals, in this case the integers from 0 to 9, are disposed on the substrate 12 in groups. For example, in this embodiment, the first group is enclosed in dashed-box 20 and a second group is enclosed in dashed-box 21. In this embodiment, each group, for example, 20 and 21, consists of five consecutive rows and two adjacent columns, comprising the integers 0 through 9. Each group has a sequence of the integers 0 through 9 that is different from the sequence of its adjacent groups. Thus, by placing a plurality of groups side-by-side, the sequence representing numerals appear random. Or, the sequence representing numerals may actually be placed on the card in a random manner. Alternatively, the formation of the groups may consist of [, for example,] one row or column comprising the integers 0 through 9. Additionally, symbols (such as letters) representing numerals may comprise the sequence representing means.

Figure 2:
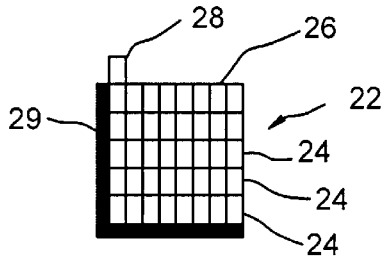
FIG. 2 is a plane view of one embodiment of the recording means of the gaming device.
Figure 3:
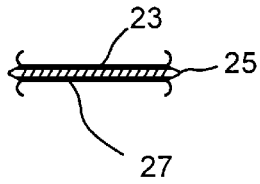
FIG. 3 is a schematic cut-away view of the recording means shown in FIG. 2.

FIG. 2 shows recording means 22 of the gaming device 10. In this embodiment, the recording means 22 is made up of individual cells 24 of a grid system 26. The recording means 22 records a predetermined sequence, such as the winning or losing numbers of a lottery-type game. The recording means 22 in this embodiment includes location aiding means 29 which is a portion marked by a shadowed area or some other mark that helps to align the recording means with the sequence representing means (shown in FIG. 1). FIG. 3 is a cutaway view showing the layers comprising the recording means 22. In this embodiment the recording means 22 is printed directly on the manufacturer's products, promotional items, or direct mail items. Alternatively, the recording means 22 may include a sheet member 23 which is paper backed by an adhesive 25. The adhesive 25 is protected by a protective backing 27, which may be peeled away so that the recording means 22 may be adhered to the packaging of a manufacturer's product or the product itself.

Figure 4:
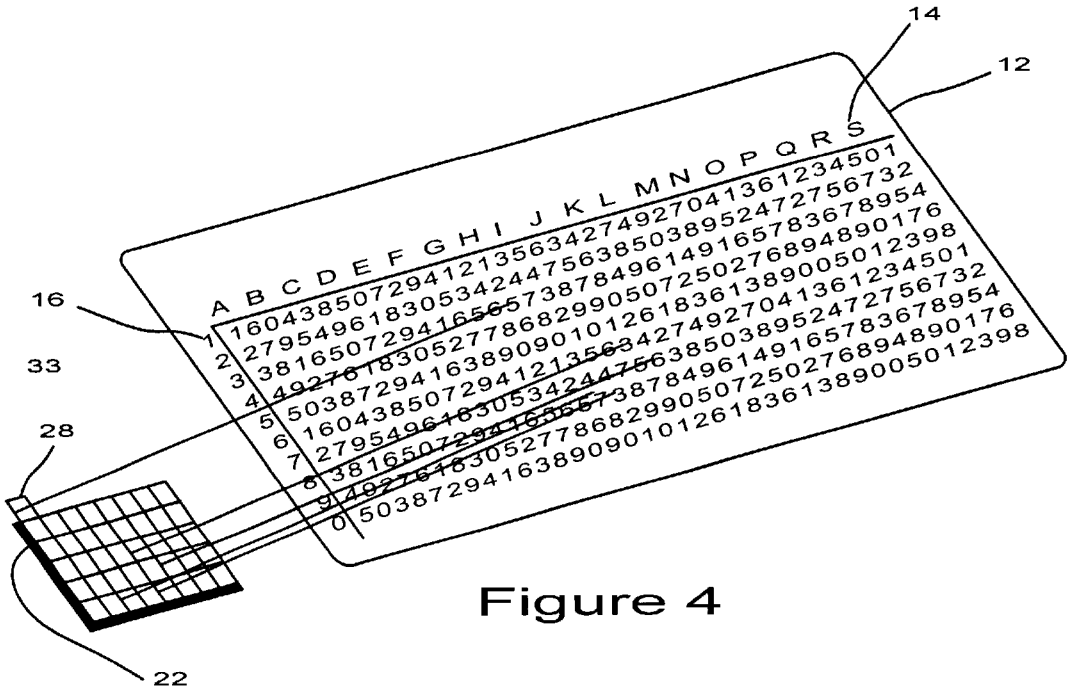
FIG. 4 is a perspective view of the gaming device.
Figure 5:
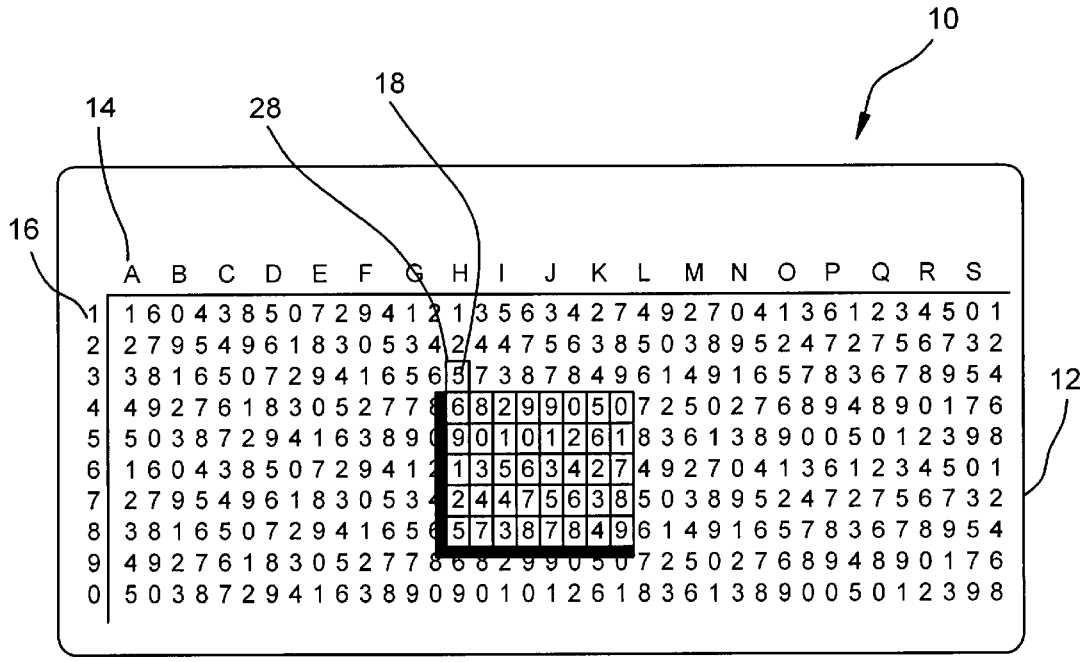
FIG. 5 is a plane view of the gaming device.

Referring to FIG. 4, an intended use of the first embodiment of the gaming device 10 will be described. The substrate 12 has a plurality of first location designating symbols, such as letters 14 disposed in a row. A plurality of second location designating symbols, such as numerals 16, are disposed in a column. The first and second location designating symbols are disposed in relation to each other so that a location 18 may be designated by a combination of one of the first location designating symbols, for example the letter H, and one of the second location designating symbols, for example the numeral 3. Thus, as shown by a line-of-sight line 33, the location aiding means 29 of the recording means 22 is located at location H3 (as shown in FIG. 5). Therefore, the player merely has to be supplied with location H3 by the game maker in order to correctly line up the recording means 22 with the substrate 12. A combination of a letter 14 and a numeral 16 may be selected for designating the location where the substrate 12 will be placed to determine the numbers to be compared to a sequence of potentially winning numbers. In this manner, D7 can be selected as the location in which case the player places the substrate 12 to determine whether a pattern printed on the recording means 22 corresponds to a predetermined sequence of numbers and is thus the winning sequence.

Figure 6:
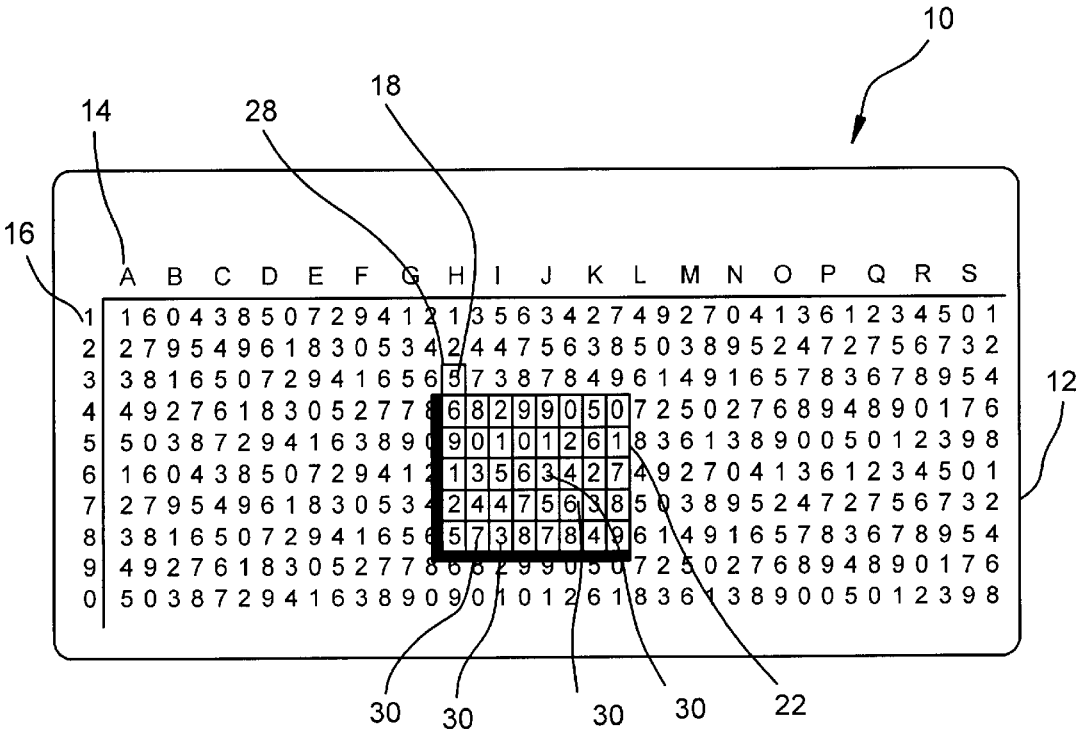
FIG. 6 is a plane view of the gaming device shown in use.
Figure 7:
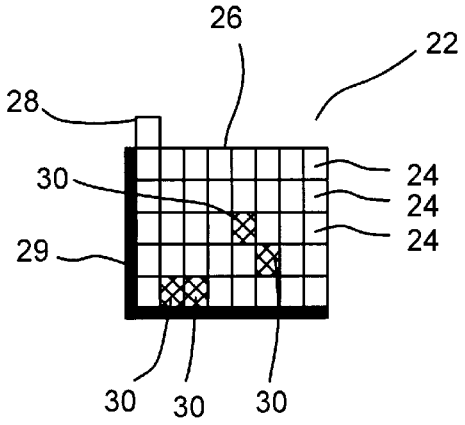
FIG. 7 is a plane view of the recording means of the gaming device shown in use.
Figure 10:
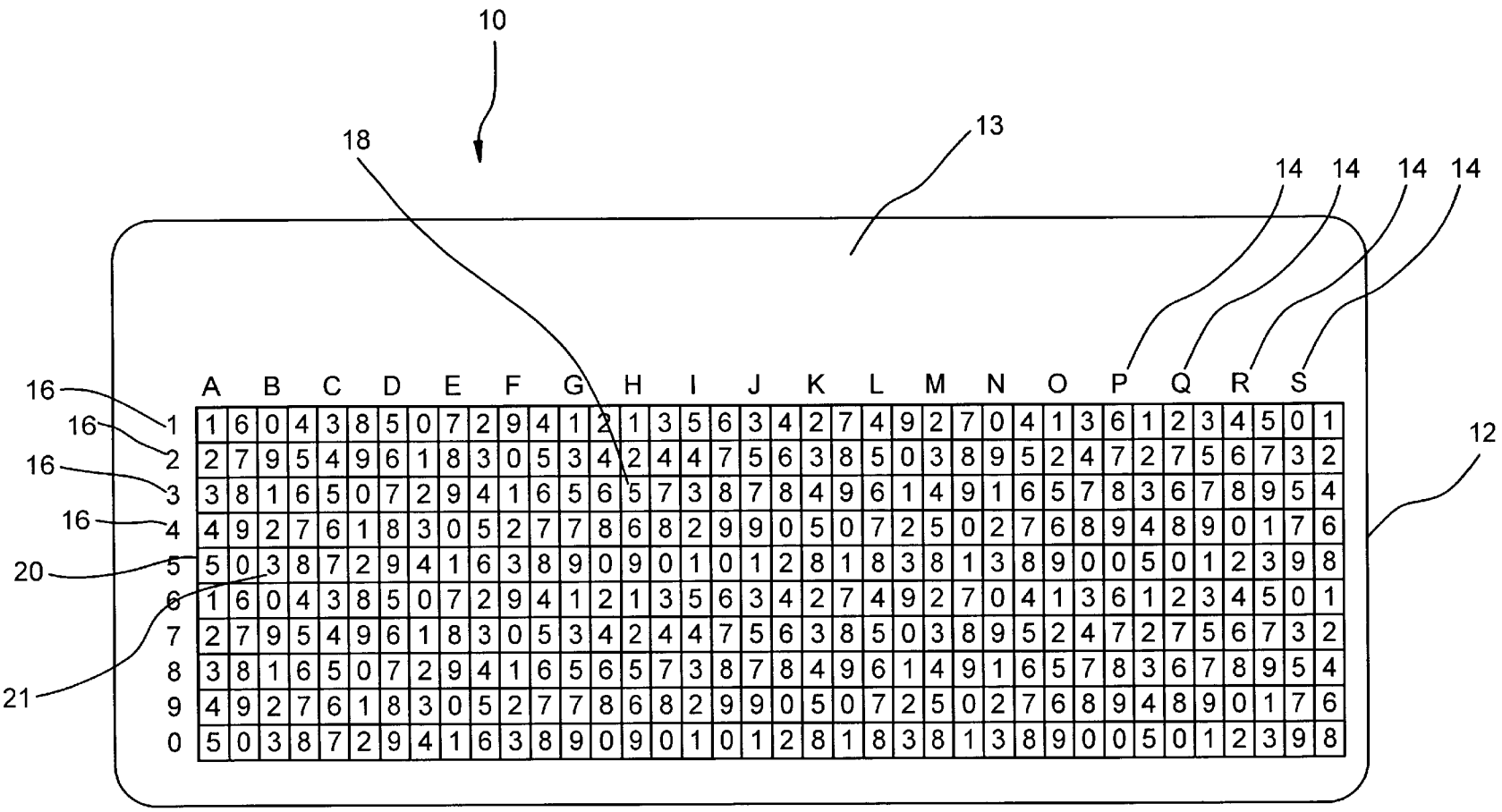
FIG. 10 is a plane view of yet another embodiment of the substrate of the gaming device.

Referring to FIG. 4 through FIG. 7, the recording means 22 is comprised of a paper sheet 23 having an adhesive backing 25. To determine his win/lose status the player places the substrate 12 over the recording means 22 so that the grid system 26 of the recording means 22 lines up with the sequence representing means or a grid system 26 disposed on the substrate 12 (shown in FIG. 10). The locating means 28 of the recording means 22 is thus visible through the substrate 12 at a selected location, in this case, H3. Next, the player determines which numbers on the substrate 12 correspond with a preprinted pattern or marks 30 on the recording means. For example, as shown in FIG. 5 through FIG. 7, if the winning sequence is 7336, the preprinted pattern or marks 30 on the recording means 22 will correspond to those numbers on the substrate.

In accordance with the present invention, the manufacturer may remove the sheet member 23 from its protective backing 27 to expose the adhesive 25 and place the recording means 22 on its product or packaging, or it may preprint the recording means directly onto its product, packaging, direct mail, or any other material.

For example, the recording means 22 can be printed on a package of a manufacturer's food product, and the consumer can determine if he is a winner by placing his substrate 12 over the printed recording means 22. If the printed recording means 22 corresponds to the proper predetermined sequence of numbers, the consumer is a winner. The consumer then notifies the manufacturer of the winning sequence, and the manufacturer verifies the winning by matching the pattern on the recording means 22 with the serial number of the substrate 12. Once the consumer contacts the manufacturer to notify the manufacturer that the consumer has matched the sequence, the manufacturer has obtained data pertaining to who has bought its product and the consumer's demographic location. Instead of printing the recording means 22 on the package, the manufacturer may enclose a game card with the printed recording means 22 on it inside the package. In this instance, the winning consumer need only to mail the winning ticket to the manufacturer for verification.

Figure 8:
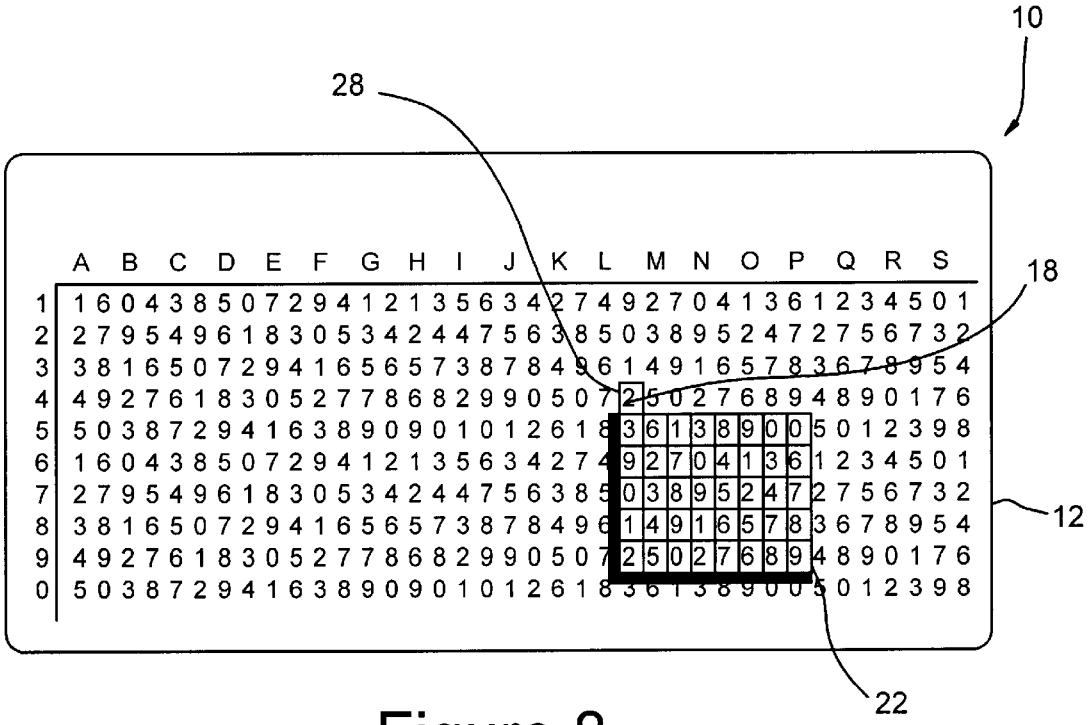
FIG. 8 is a plane view of the gaming device showing the recording means at a correct location.

As shown in FIG. 8, if the substrate 12 is placed over the recording means 22 and the player is a "loser," the sequence which will be perceived by reading the marks 30 (in this case 5055) will not correspond with the desired winning sequence.

Figure 9:
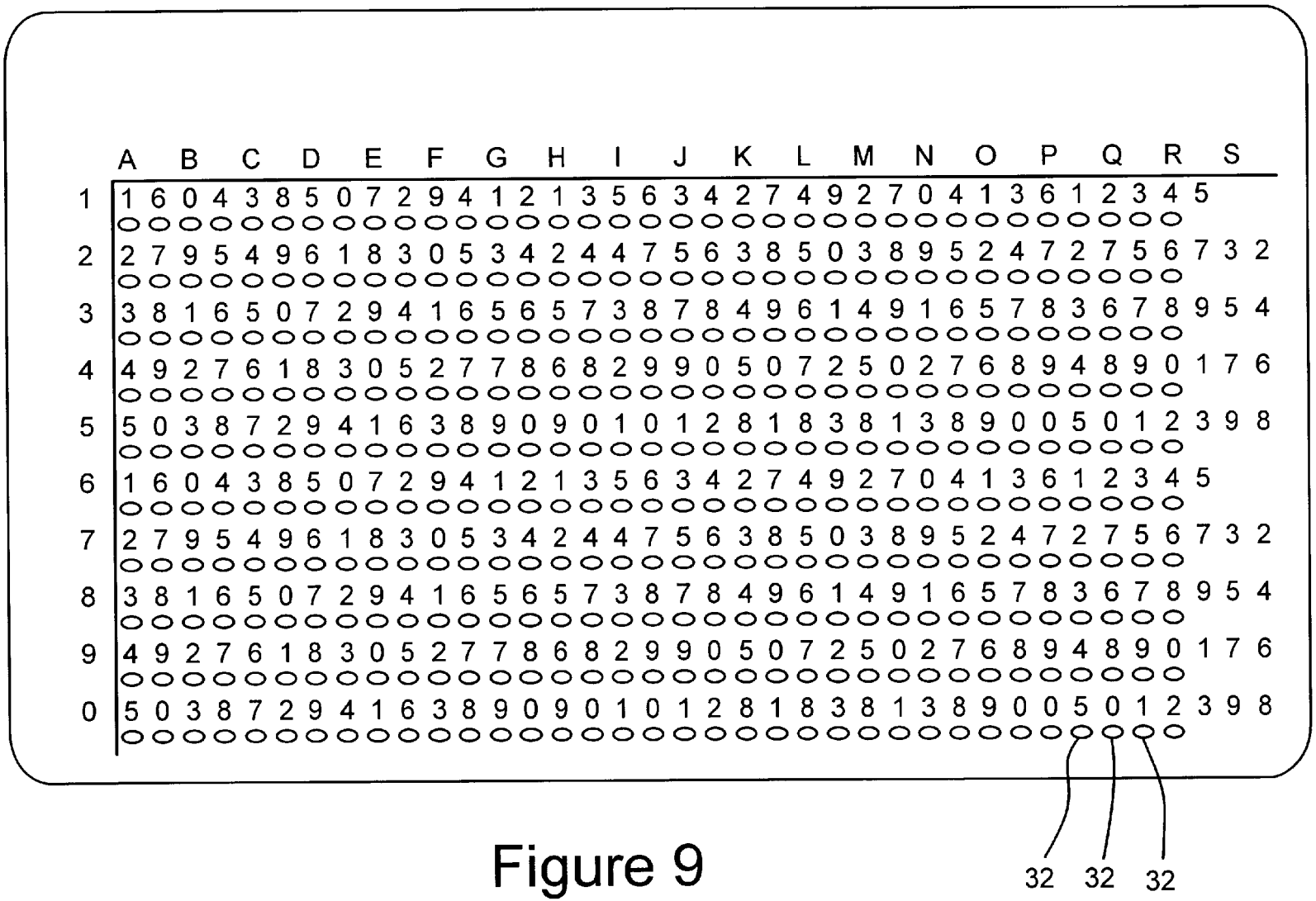
FIG. 9 is a plane view of another embodiment of the substrate of the gaming device.

In an alternative embodiment, as shown in FIG. 9, the substrate 12 has a plurality of holes 32 and each hole corresponds with one of the sequence representing elements. Therefore, in accordance with this embodiment, the player merely has to match up the pattern made by the recording means 22 corresponding with holes 32 of the substrate 12 to determine if the player is a "winner."

Referring to FIG. 1 through FIG. 7, methods for writing and reading winning and losing sequences using the gaming device 10 will be described. The method of writing the winning and losing sequences for the gaming device 10 comprises the steps of placing the substrate 12 over the recording means 22 so that the locating aiding means 29 is visible through the substrate 12 at a preselected location (for example, H3). Or, alternatively, sequences can be written by placing a transparent recording means 22 over the substrate 12. Next, the individual cells 24 of the recording means 22 which are associated with each sequence representing element which sequentially corresponds with a respective sequence element of the winning or losing sequence are perceived. Finally, each of the appropriate individual cells 24 are marked, for example, by placing a mark 30, so as to thereby record winning or losing sequences.

Once the sheet member 23 of the recording means 22 has been marked as described above, it may be read by the following method in order to determine if the sequence is a winner or a loser. First, the substrate 12 is placed over the recording means 22 at the preselected location (for example, H3). Next, the individual marks 30 in the cells 24 of the recording means 22 are perceived through the substrate 12 to thereby read the respective sequence representing element and thus reconstruct the winning or losing sequence, in this case 7336.

Figure 11:
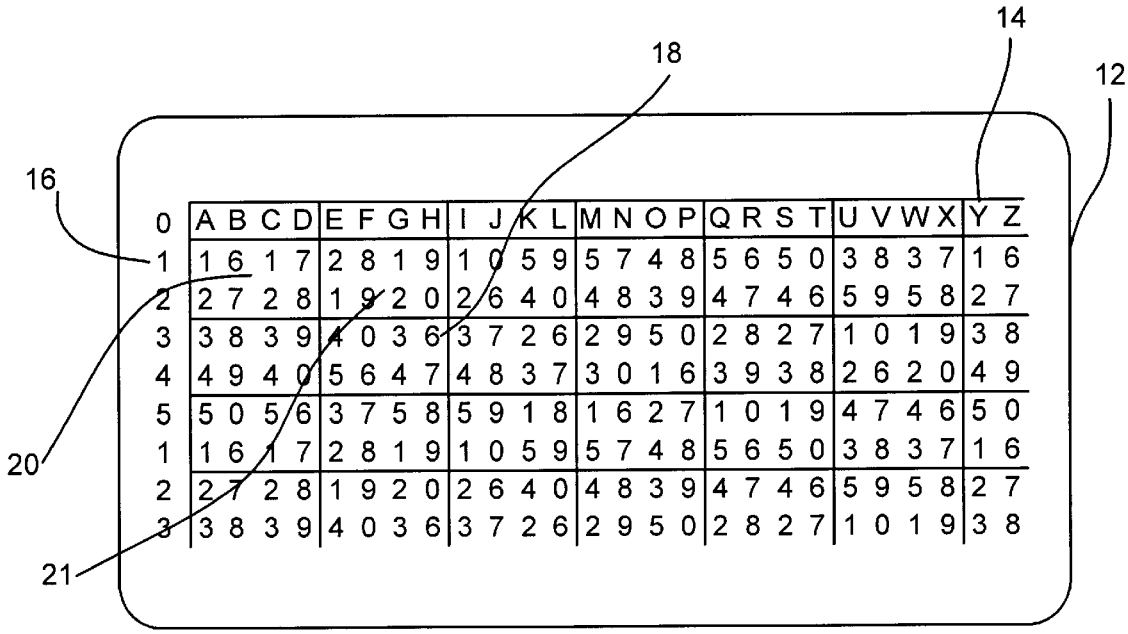
FIG. 11 is a plane view of still another embodiment of the substrate of the gaming device.
Figure 11A:
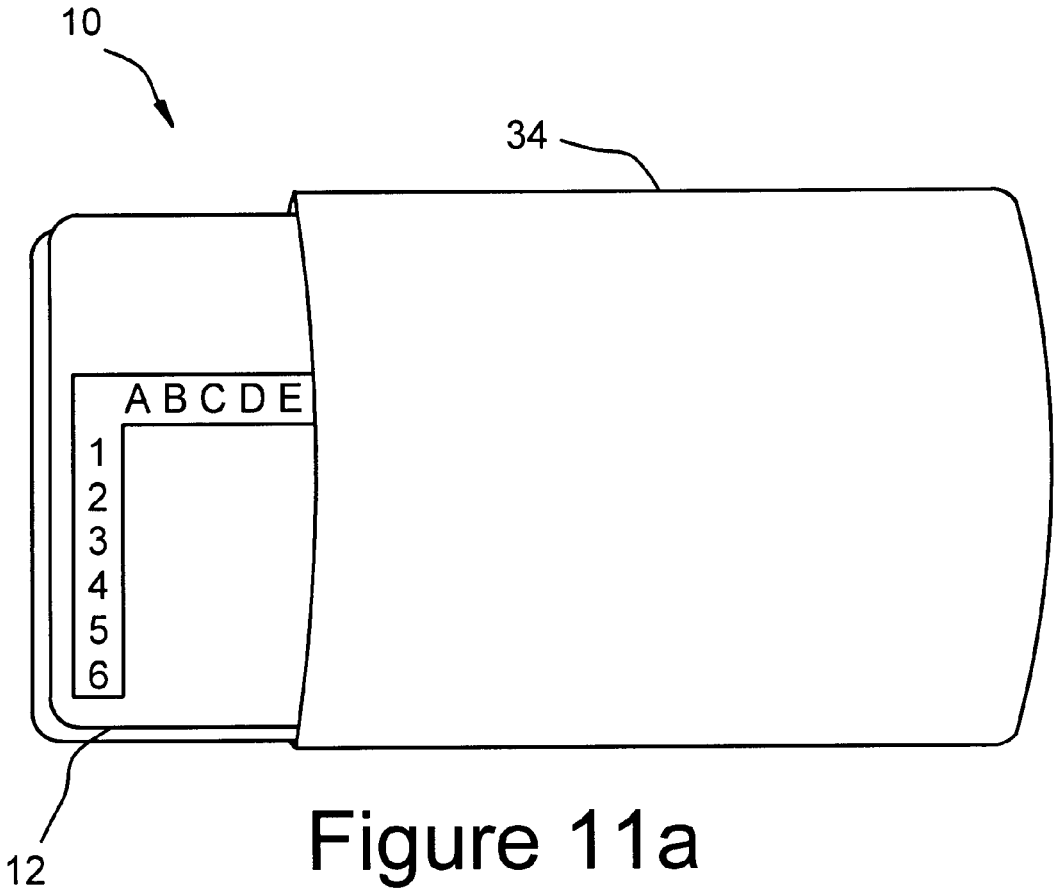
FIG. 11*a* is a plane view of the substrate of the gaming device placed partially inside of its protective sleeve.

Referring to FIG. 11, an embodiment of the gaming device 10 is shown in which letters 14 are disposed so that each of the columns of numbers is designated by a letter. In this case, every other column has the numerals 1 through 5 and its adjacent column has the numerals 0 through 6. By this arrangement, every group of numbers (2 columns times 5 rows) will have the digits 0 through 9, thus, facilitating the use of the invention. The gaming device 10 can be held and carried in a protective sleeve 34, as shown in FIG. 11*a*, while not in use.

One application of the gaming device involves the operation of a collectibles or loyalty system where the numbers shown give a number of points that, when collected, allow for the redemption of prizes from a catalog. The individual marks 30 in the cells 24 of the recording means 22 are perceived through the substrate 12 and read. The values of the numbers corresponding to the individual marks 30 are then summed to arrive at a point value. The points can then be redeemed for prizes or banked to collect a larger prize at a later date when more points are collected.

The system may also be operated across landline and mobile telephone networks, as well as telephonic paging systems. A player having a gaming device 10 and a recording means 22 preprinted on a card, the protective sleeve 34 holding the gaming device 10, or some other item can call a telephone number and listen to pre-recorded messages about products, offers, and services. Lifestyle information is collected in exchange for a location aiding means 29 and a winning number sequence. In the telephone version, as in all versions, if a person wishes to participate and he has not already received details of the promotion, a gaming device 10 and a recording means 22 can be sent to the person in exchange for his providing of his lifestyle data as well as his address. The lifestyle information and player responses can be collected using Interactive Voice Telephony or Interactive Voice Response/Recognition.

Figure 12:
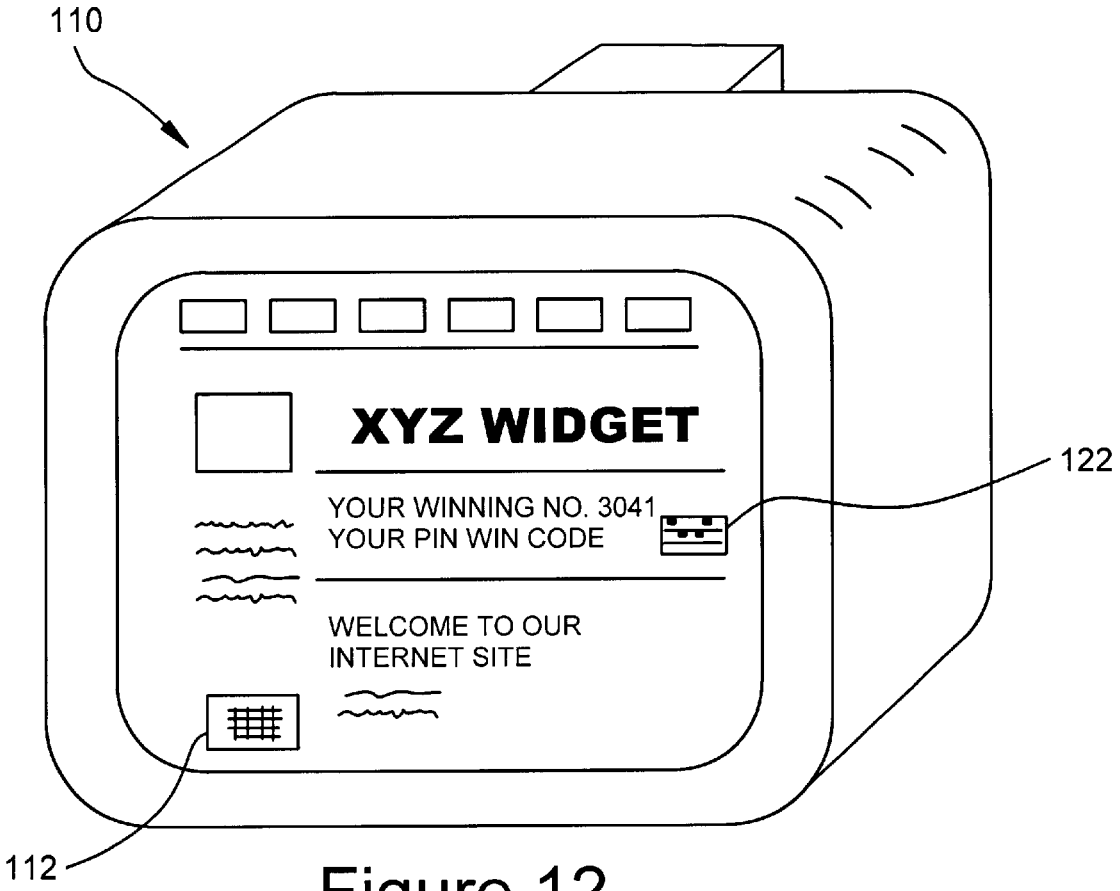
FIG. 12 is a plane view of the inventive system applied to an Internet gaming scheme and illustrating a web page of a manufacturer subscribing to the gaming system.

The inventive system can be played on a computer connected to either a remote database or the Internet. FIG. 12 depicts the inventive system as it would be applied to an Internet gaming scheme. In this embodiment 110, a computer monitor is shown illustrating a web page of a manufacturer which subscribes to the inventive gaming system. After a player registers with the manufacturer or a company providing promotional services for a group of manufacturers and becomes a game player, a virtual substrate 112 appears as an icon on a portion of the player's computer screen as the player navigates the various manufacturer web sites that subscribe to the promotional gaming system. Virtual substrate 112 contains all of the characteristics of substrate 12 described earlier, but is virtually projected onto the viewing screen when a game player visits the web site of a subscribing manufacturer or supplier of goods or services. Virtual substrate 112 is mated with virtual recording means 122 by "clicking and dragging" virtual substrate 112 and dropping it onto recording means 122.

Figure 13:
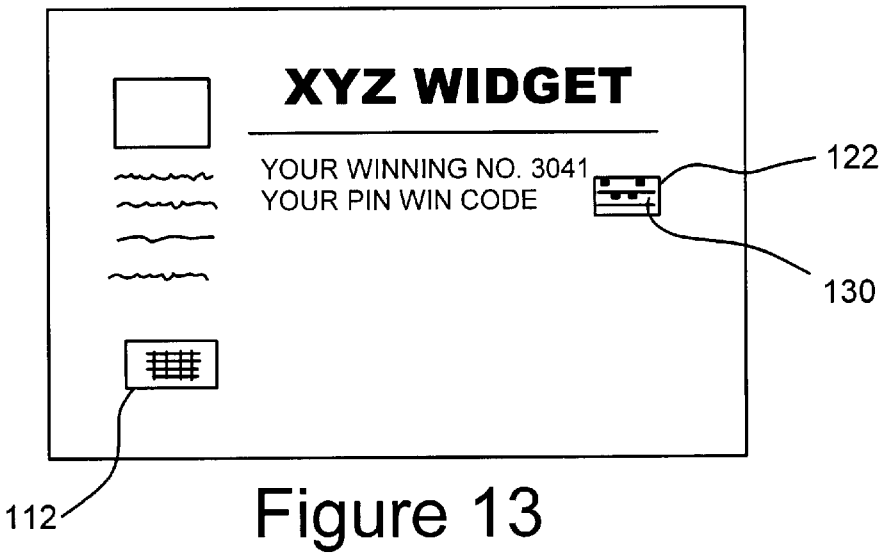
FIG. 13 is a computer-screen view of a web page illustrating a virtual substrate and a virtual recording means.

FIG. 13 illustrates the virtual substrate 112 as it is "clicked on and dragged" over to the virtual recording means 122. In the same manner as in FIG. 5, if the virtual marks 130 of the virtual recording means 122 match the winning numbers (in this case 3041), then the player is a winner. The player may then contact the web site host by e-mail or post to notify it of his winning match-up and collect his prize.

Alternatively, only the reference and winning sequence numbers may be given to a player over the computer as shown in FIG. 13A. Here, the player obtains the reference and winning sequence numbers from the computer according to the usual preset parameters, but instead the player uses the physical version of the gaming device to determine if he is a winner.

Responses and information collected as a result of a person playing the game either over the computer or by telephone can also be verified under the system. For example, if a player has entered an answer inconsistent with a previous answer for the same or similar questions, both answers are flagged. The inconsistency in the one answer (or both answers if neither have been reported outside the system) can then be corrected before the information is disseminated.

Figure 14:
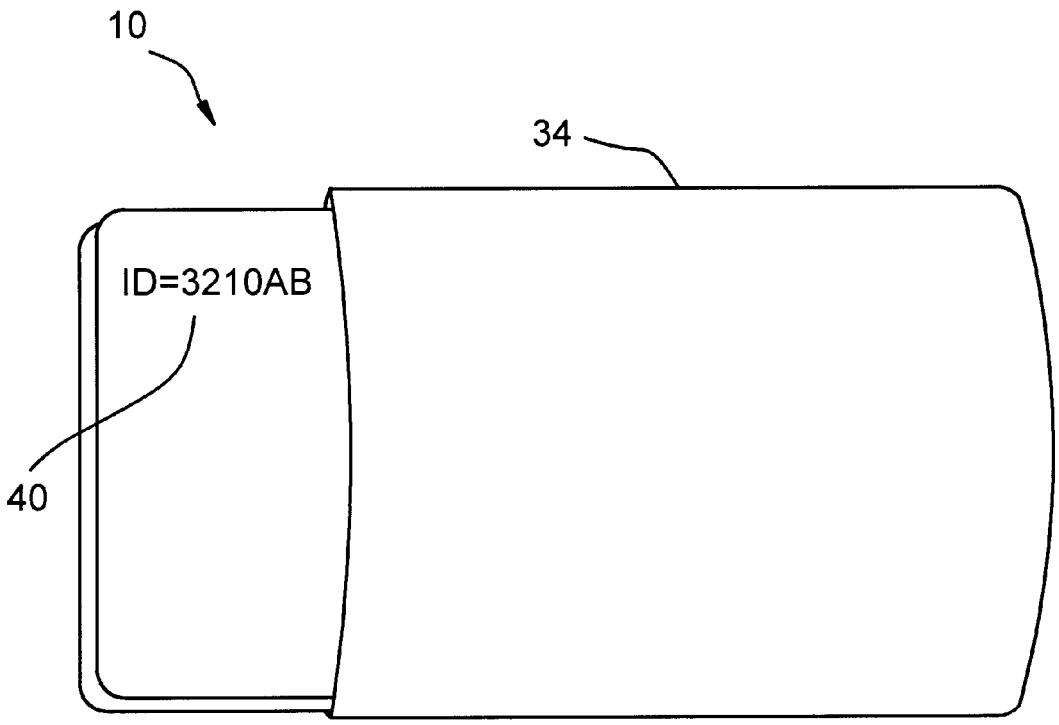
FIG. 14 is a plane view of the substrate of the gaming device placed partially inside its protective sleeve and having an identifying number printed directly on the substrate.
Figure 15:
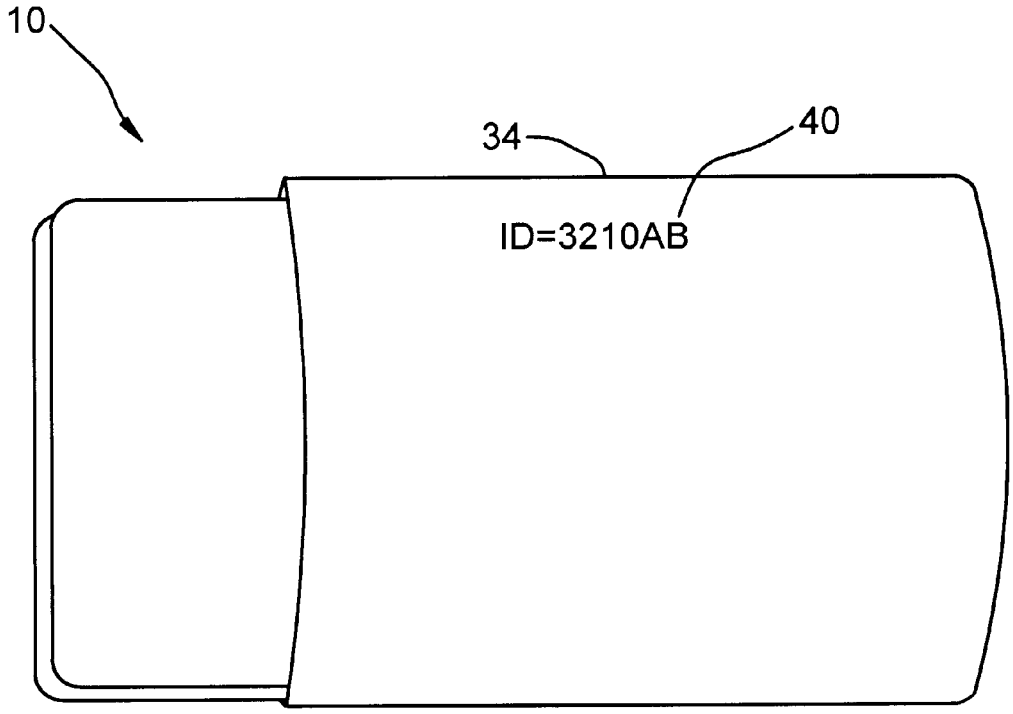
FIG. 15 is a plane view of the substrate of the gaming device placed partially inside its protective sleeve and having an identifying number printed directly on the protective sleeve.

In both the telephone and Internet versions of the game, as well as other versions of the game, each gaming device 10 may have a unique identifying number 40 associated with it enabling the administrator of the game or promotion to recognize which promotion the gaming device 10 relates to. The unique identifying number 40 may be printed directly on the card as in FIG. 14, or it may be printed on the protective sleeve of the card 34 as shown in FIG. 15. Players using the gaming device 10 via the Internet or telephone could be required to enter the unique identifying number 40 prior to participating in the promotion in order to allow the administrator of the game to determine whether the player has played the game before and, if so, to which promotion the gaming device 10 relates. This unique identifying number 40 would allow the game administrator to switch from a promotional device on products, etc., to the Internet or telephone version.

With respect to the above description, it is realized that the optimum dimensional relationships for parts of the invention, including variations in size, materials, shape, form, function, and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention.

What is claimed is:

1. A promotional gaming device for determining whether a player has matched a predetermined winning sequence of characters or symbols, said gaming device comprising:

(a) a substrate having at least one first location designating symbols and at least one second location designating symbols, said first location designating symbols being disposed in relation to said second location designating symbols so that a position may be designated by a positional combination of at least one of said first location designating symbols and at least one of said second location designating symbols;

(b) a plurality of groups of sequence representing elements disposed on said substrate, said sequence representing elements having a corresponding position designated by said positional combination of at least one of said first location designating symbols and at least one of said second location designating symbols;

(c) a promotional product label having a plurality of marks disposed thereon, each of said marks being addressable by one of said sequence representing elements when said substrate is placed over said promotional product label or said promotional product label is placed over said substrate, each of said marks identifying a sequence representing element that in combination forms a gaming sequence, the gaming sequence being compared to said predetermined winning sequence to determine a match; and (d) an indicator, said indicator disposed on said promotional product or as an independent entity, said indicator indicating a point of addressability between said promotional product label and said substrate.

2. The gaming device according to claim 1 wherein said substrate is transparent.

3. The gaming device according to claim 1 wherein said substrate is translucent.

4. The gaming device according to claim 1 wherein said first location designating symbols are arranged in a row and said second location designating symbols are arranged in a column.

5. The gaming device according to claim 1 wherein said sequence representing elements comprise the integers 0 through 9.

6. The gaming device according to claim 1 wherein said sequence representing elements comprise letters.

7. The gaming device according to claim 1 wherein said predisposed sequence representing elements of each group are predisposed on said substrate in varying patterns.

8. The gaming device according to claim 1 wherein said predisposed sequence representing elements of each group are predisposed on said substrate in a random manner.

9. The gaming device according to claim 1 wherein said gaming device can be reused for subsequent games.

10. A method of playing a game using a gaming device comprising the steps of:

(a) placing a gaming card over a promotional product label having a plurality of marks disposed thereon, said gaming card comprising (i) a substrate having at least one row of a plurality of first location designating symbols and at least one column of a plurality of second location designating symbols, said first location designating symbols being disposed in relation to said second location designating symbols so that a position may be designated by a positional combination of at least one of said first location designating symbols and at least one of said second location designating symbols; and (ii) a plurality of groups of sequence representing elements disposed on said substrate, said sequence representing elements having a corresponding position designated by said positional combination of at least one of said first location designating symbols and at least one of said second location designating symbols;

each of said marks being addressable by one of said sequence representing elements when said gaming card is placed over said promotional product label at a location as indicated by an indicator, said indicator being disposed on said promotional product or as an independent entity;

(b) locating each address where said marks are visible below each of said sequence representing elements;

(c) identifying a corresponding sequence element, said sequence element forming a portion of a gaming sequence;

(d) comparing said gaming sequence representing elements to a predetermined winning sequence.

11. The method as in claim 10, wherein said substrate is transparent.

12. The method as in claim 10, wherein said substrate is translucent.

13. The method as in claim 10, wherein said first location designating symbols are arranged in a row and said second location designating symbols are arranged in a column.

14. The method as in claim 10, wherein said sequence representing elements comprise the integers 0 through 9.

15. The method as in claim 10, wherein said sequence representing elements comprise letters.

16. The method as in claim 10, wherein said predisposed sequence representing elements of each group are predisposed on said substrate in varying patterns.

17. The method as in claim 10, wherein said predisposed sequence representing elements of each group are predisposed on said substrate in a random manner.

18. A promotional gaming device for determining whether a player has matched a predetermined winning sequence comprising:

(a) a first graphical element having at least one row of a plurality of first location designating symbols and at least one column of a plurality of second location designating symbols, said first location designating symbols being disposed in relation to said second location designating symbols so that a position may be designated by a positional combination of at least one of said first location designating symbols and at least one of said second location designating symbols;

(b) a plurality of groups of sequence representing elements displayed on said first graphical element, said sequence representing elements having a corresponding position designated by said positional combination of at least one of said first location designating symbols and at least one of said second location designating symbols; and (c) a second graphical element having a plurality of marks disposed thereon, each of said marks being addressable by one of said sequence representing elements when said first graphical element is placed over said second graphical element, each of said marks identifying a sequence representing element that in combination forms a gaming sequence which can be compared to said predetermined winning sequence; and (d) an indicator, said indicator disposed on said second graphical element or as an independent entity, said indicator indicating a point of addressability between said first graphical element and said second graphical element.

19. The promotional gaming device of claim 18, wherein said first graphical element is electronically projected by a computer onto a computer screen.

20. The promotional gaming device of claim 19, wherein said computer is connected to a remote database.

21. The promotional gaming device of claim 20, wherein said computer is connected to at least one local area network (LAN) or at least one wide area network (WAN), optionally the Internet, or at least one LAN and at least one WAN.

22. The promotional gaming device of claim 21, wherein said promotional gaming device has an identifying code associated with said promotional gaming device.

23. The promotional gaming device of claim 18, wherein said second graphical element is electronically displayed on a computer screen.

24. The promotional gaming device of claim 23, wherein said computer is connected to a computer that is connected to a remote database.

25. The promotional gaming device of claim 24, wherein said computer is connected to at least one local area network (LAN) or at least one wide area network (WAN), optionally the Internet, or at least one LAN and at least one WAN.

26. The promotional gaming device of claim 25, wherein said promotional gaming device has an identifying code associated with said promotional gaming device.

27. The promotional gaming device of claim 18, wherein a user can position a cursor over said first graphical element and activate a dragging element enabling said user to position said first graphical element over said second graphical element.

28. The promotional gaming device of claim 18, wherein said marks are perceivable through said first graphical element and each of said marks correlate with a sequence representing element, each of said sequence representing elements which correlate with a mark combined to form a gaming sequence which is compared to a predetermined winning sequence.

29. A method of playing a game using a gaming device comprising the steps of:

(a) placing a gaming card over a plurality of marks disposed on a promotional product label having a plurality of marks disposed thereon, said gaming card comprising (i) a substrate having at least one row of a plurality of first location designating symbols and at least one column of a plurality of second location designating symbols, said first location designating symbols being disposed in relation to said second location designating symbols so that a position may be designated by a positional combination of at least one of said first location designating symbols and at least one of said second location designating symbols; and (ii) a plurality of groups of sequence representing elements disposed on said substrate, said sequence representing elements having a corresponding position designated by said positional combination of at least one of said first location designating symbols and at least one of said second location designating symbols;

each of said marks being addressable by one of said sequence representing elements when said gaming card is placed over said promotional product label at a location as indicated by an indicator, said indicator being disposed on said promotional product or as an independent entity;

(b) locating each address where said marks are visible below each of said sequence representing elements;

(c) collecting points based on the result of a mathematical computation derived from the integral values corresponding to said marks at each of said addresses; and (d) redeeming points collected from said mathematical computation for a prize.

30. A promotional gaming device for determining whether a player has matched a predetermined winning sequence of characters or symbols, as claimed in claim 1 wherein said groups of sequence representing elements are comprised of at least one group of sequence representing members, said group of sequence representing members containing a group of digits, said digits being in a sequential order as oriented in a geometrical pattern.

31. A promotional gaming device for determining whether a player has matched a predetermined winning sequence of characters or symbols, as claimed in claim 1 wherein said at least one group of sequence representing members are repeated in other areas of said substrate.

32. A promotional gaming device for determining whether a player has matched a predetermined winning sequence of characters or symbols, as claimed in claim 1 wherein said at least one group of sequence representing members are repeated contiguously to said at least one group of sequence representing members on said substrate.

33. A method of playing a game using a gaming device as claimed in claim 10 wherein said promotional product label is placed over said gaming card.

34. A promotional gaming device for determining whether a player has matched a predetermined winning sequence of characters or symbols as claimed in claim 1 wherein said first location designating symbols designate rows, and said second location designating symbols designate columns in a matrix.

35. A promotional gaming device for determining whether a player has matched a predetermined winning sequence of characters or symbols as claimed in claim 1 wherein said first location designating symbols designate a plurality of rows, and said second location designating symbols designate a plurality of columns in a matrix.

* * * * *